US006010264A

United States Patent [19]

Scuderi et al.

[11] Patent Number: 6,010,264

[45] Date of Patent: Jan. 4, 2000

[54] COMBINED CONTAINER AND APPLICATOR FOR SUN LOTION AND OTHER SOLUTIONS

[75] Inventors: Richard Scuderi, Margate, N.J.; Thomas J. Freeman, Stone Mountain, Ga.

[73] Assignee: Tom Freeman, Woodstock, Ga.

[21] Appl. No.: 09/036,447

[22] Filed: Mar. 6, 1998

Related U.S. Application Data

[60] Provisional application No. 60/039,993, Mar. 6, 1997.

[51] Int. Cl.[7] ..... A47L 11/08

[52] U.S. Cl. ..... 401/21; 401/6; 401/209; 401/219

[58] Field of Search ..... 401/21, 6, 16, 401/17, 209, 213, 219, 216

[56] References Cited

U.S. PATENT DOCUMENTS

| | | | |
|---|---|---|---|
| D. 58,687 | 8/1921 | Robinson | D9/373 |
| D. 79,074 | 7/1929 | Groth | D9/329 |
| D. 155,031 | 8/1949 | Patterson | D9/338 |
| D. 175,383 | 8/1955 | Bamberger | D9/373 |
| D. 197,107 | 12/1963 | Forgue | D28/7 |
| D. 200,385 | 2/1965 | Tinsley | D28/7 |
| D. 219,204 | 11/1970 | Weiner | D9/373 |
| D. 222,939 | 2/1972 | Haas | D9/373 |
| D. 238,972 | 2/1976 | Greene et al. | D28/7 |
| D. 247,317 | 2/1978 | Mantelet | D28/7 |
| D. 256,626 | 9/1980 | Kozlowski | D9/373 |
| D. 285,172 | 8/1986 | Scuderi | D9/338 |
| 5,125,757 | 6/1992 | Morrison et al. | 401/21 |
| 5,419,646 | 5/1995 | Taylor | 401/21 |

*Primary Examiner*—David J. Walczak

[57] ABSTRACT

A method and apparatus for applying various topical solutions, the ends of which are able to either spray, roll or sponge on (or a combination of the aforementioned) various topical solutions applied to a living body. The sprayer enables the user to spray on various liquid products. The roller ball enables the user to apply topical solutions with a massage effect. The sponge or sponges enable the user to apply a wide range of solutions while achieving a cleansing effect. The present invention greatly improves upon the functionality and appearance of the product known as Reach-It of DES 285,172 and utility U.S. Pat. No. 4,571, 106.

5 Claims, 5 Drawing Sheets

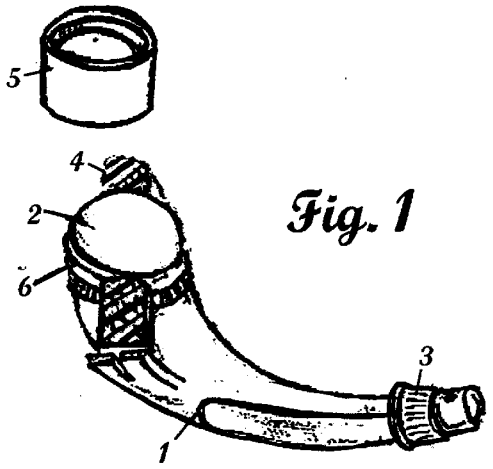
Fig. 1
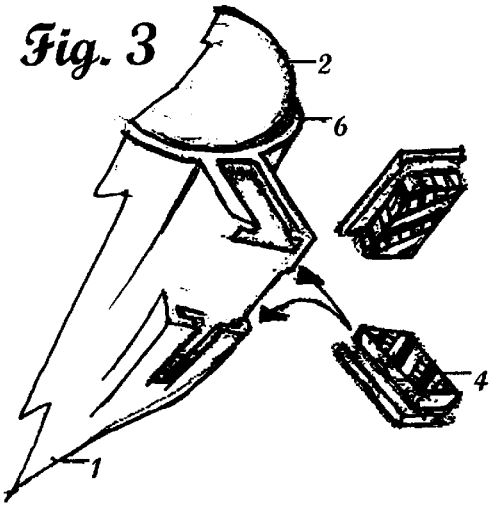
Fig. 3
Fig. 4
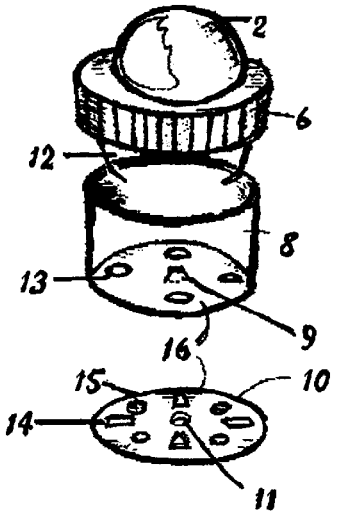
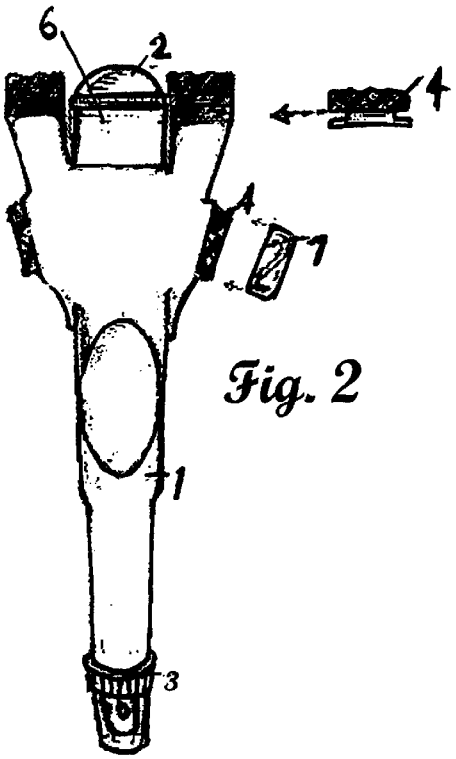
Fig. 2
Fig. 5
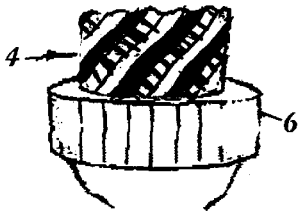

5
7
4
3

5
1
3
7
4

COMBINED CONTAINER AND APPLICATOR FOR SUN LOTION AND OTHER SOLUTIONS

This application claims benefit of provisional application 68/039,993, filed Mar. 6, 1997.

BACKGROUND OF THE INVENTION

This invention relates to an improved combined-container and applicator for various items applied to the human body or the body of a pet.

Health and appearance awareness is reaching new heights each day. Worldwide, people are becoming ever more conscious of the basic human desires to look good and feel good. Nutrition facts are displayed on food items. More people are aware of the need to eat properly and exercise regularly. People are becoming more active physically. At the same time—because of society's fast pace—we are seeing more accidents. This invention not only offers convenience to a fast-paced society, it offers comfort to those in need of relief. Presently there are other applicator products being manufactured and marketed. However, these applicators do not contain the capabilities to effectively apply a vast array of liquids, gels, ointments, solutions, oils and medications. Today's society is in great need of a product which can effectively apply these items.

BRIEF SUMMARY OF INVENTION

This invention is directed to an improved combined container and applicator which may be filled with a wide variety of items. The object of this present invention is to provide a convenient means of applying a wide variety of topical solutions in a manner which provides comfort to the person to which a particular solution is being applied. The object of this invention is to apply body oils, lotions, gels, ointments, soaps, shampoos, balms, medicines, ice and ice water. The object of this invention is to provide a massage effect while applying said items. The object of this invention is to assist the user in reaching all areas of the body. This invention enables a person to apply a wide variety of solutions in a convenient and comfortable manner.

The improved combined container and applicator comprises a main body, spray cap, roller ball, sponges or sponge-like materials and a flow-control system to accomplish the effective application of various topical solutions. The spray cap is used in many commonly manufactured spray bottles which disperse various liquid products. The roller ball is similar to other roller balls used in the manufacture of deodorant dispensers. The roller ball is larger in size than common deodorant roller balls so-as to provide a penetrating massage effect to muscles while covering a wider area of application. The sponges are located on both sides of the roller ball and are retractable so the user has the option of removing the sponges (using the roller ball as the primary source of application). The flow control system incorporates the use of a sealer cap, a flow-tub and a control disc which all work together to control the amount of solution dispensed. The sealer cap houses the roller ball or a sponge depending on which the user prefers. With the addition of the spray cap, flow control system, sponge receptors and sponges we have greatly improved the function and appearance of our combined container and applicator.

BRIEF DESCRIPTION OF SEVERAL VIEWS OF THE DRAWINGS

FIG. 1: A perspective view of the improved combined container and applicator used to apply various topical solutions to a body.

FIG. 2: A bottom plan view of the improved combined container and applicator of FIG. 1.

FIG. 3: An enlarged sectional view illustrating retractable sponge.

FIG. 4: An exploded perspective view of the flow control system articulately connecting a roller ball or sponge to the main body of improved combined container and applicator while regulating the amount of solution dispensed from the combined container and applicator.

FIG. 5: An enlarged perspective view of sealer cap portion of flow control system containing a sponge.

FIG. 7: A view looking from the right of FIG. 1 with cap portion on.

FIG. 8: A view looking from the left of FIG. 1 with cap portion on.

DETAILED DESCRIPTION OF THE INVENTION

Figure 6:
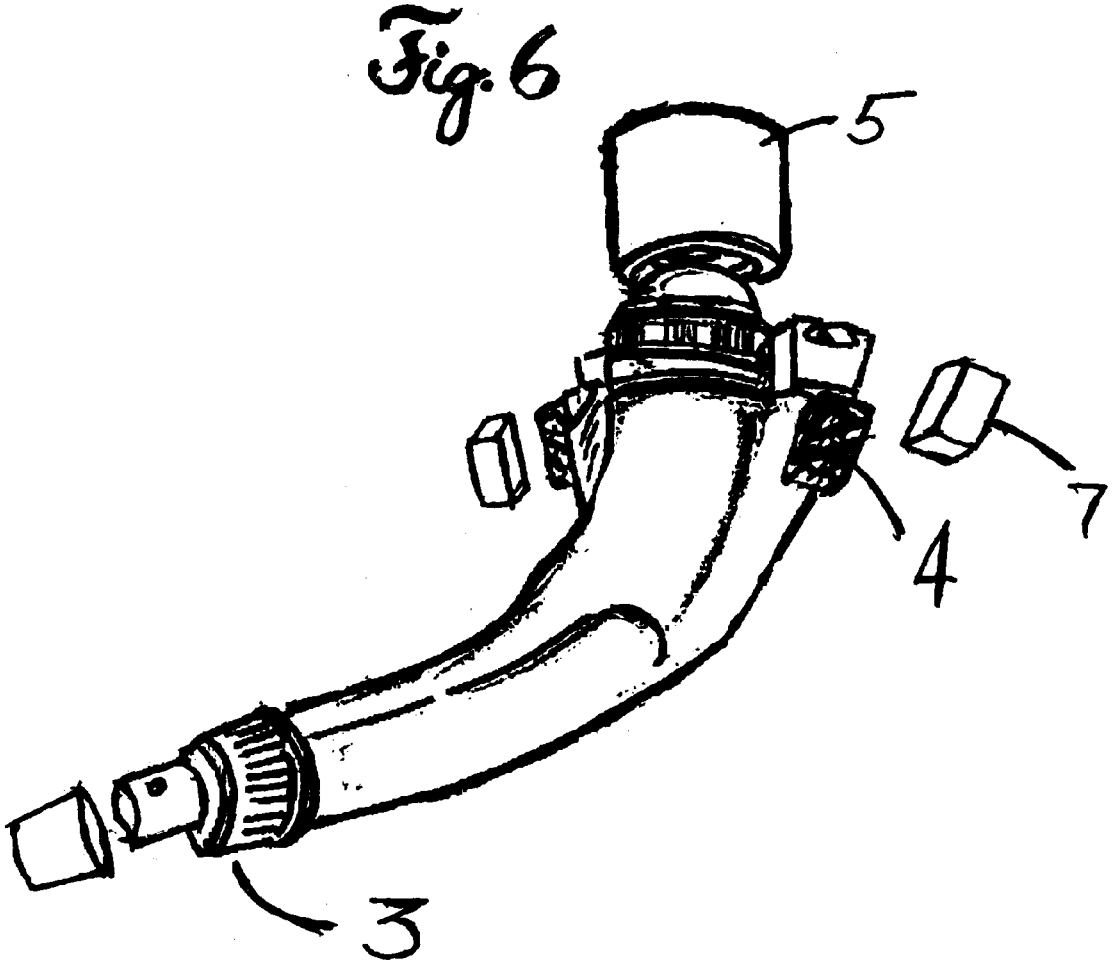
FIG. 6: A view showing side opposite that seen in FIG. 1 with sponges retracted.
Figure 7:
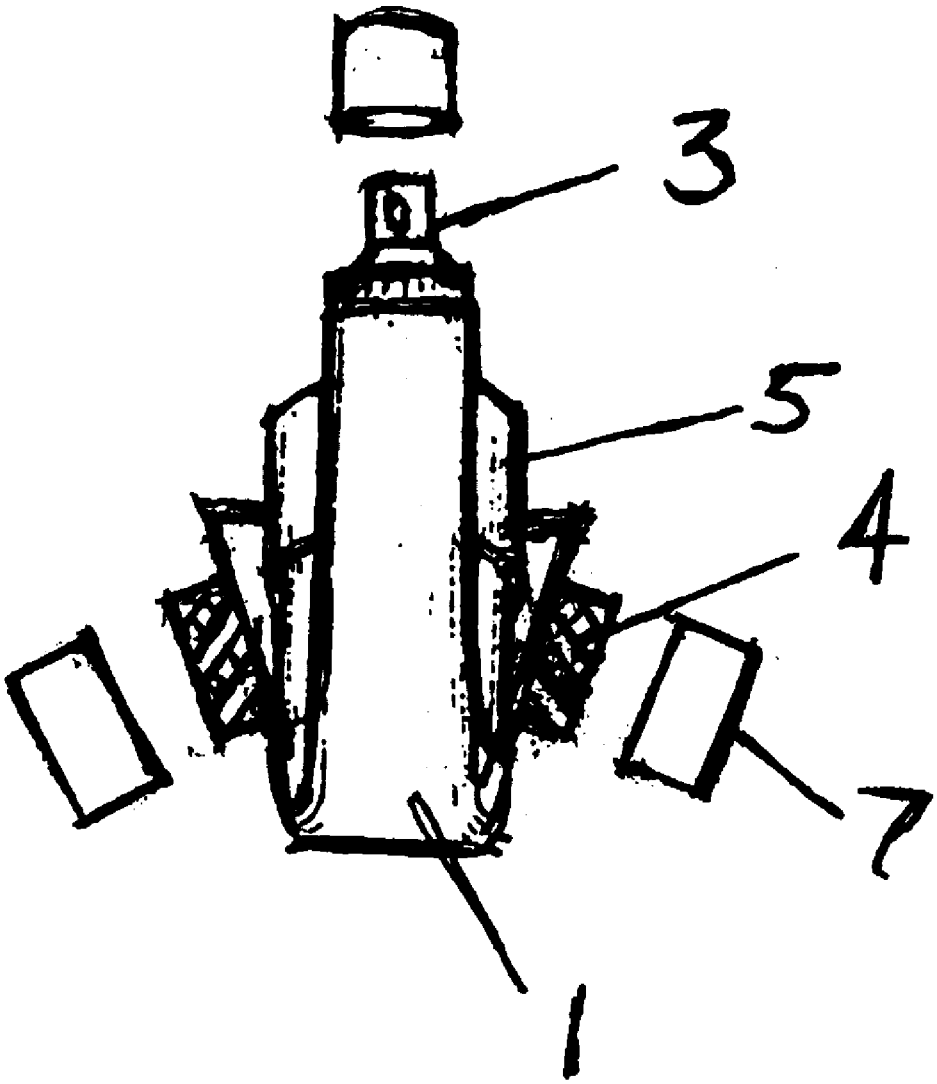
Figure 8:
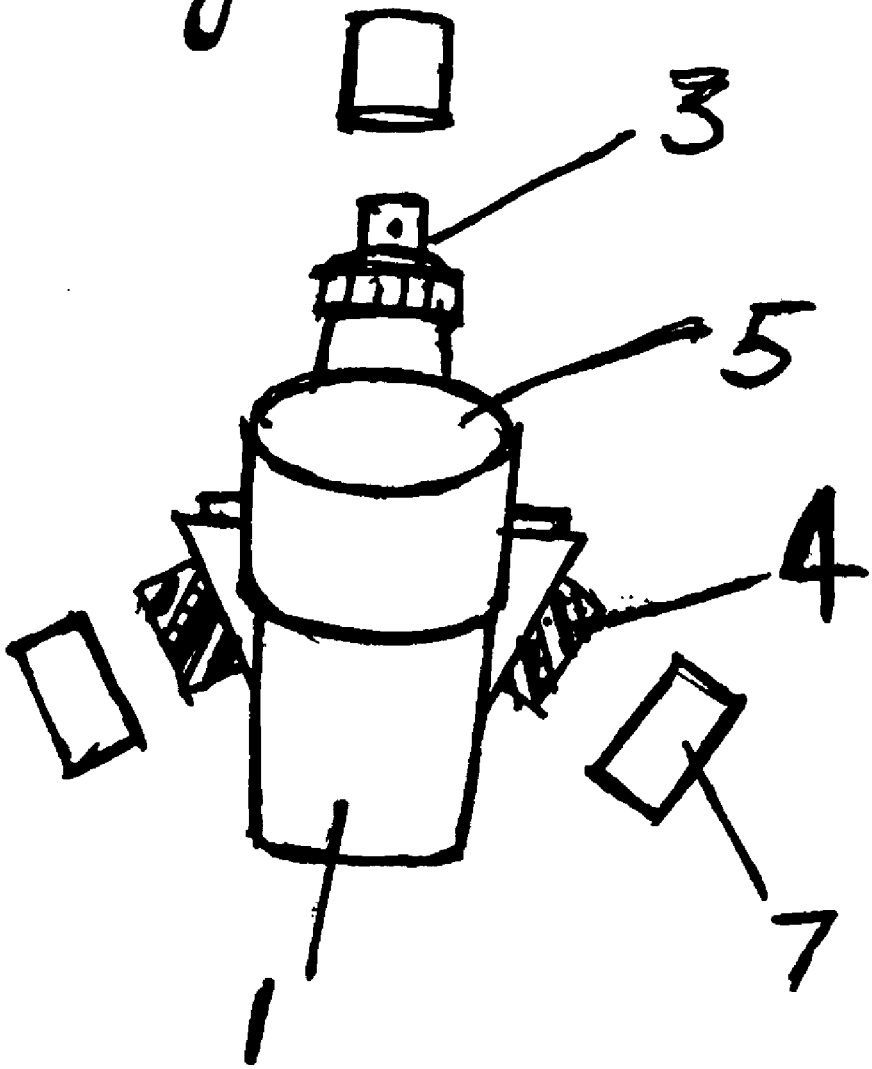
Figure 9:
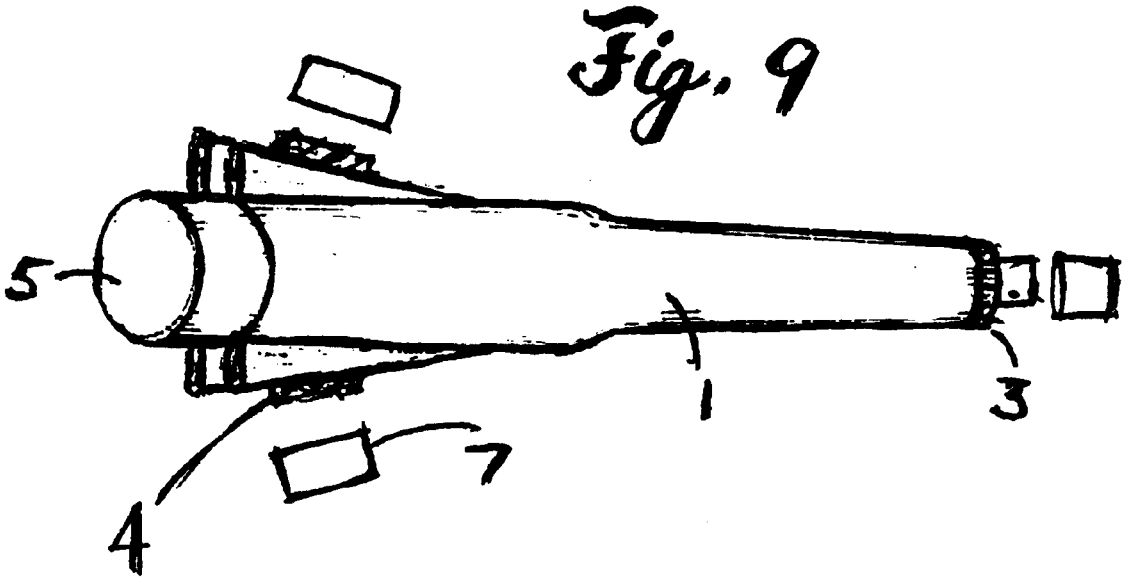
FIG. 9: A top plan view.

Broadly, the present invention comprises an improved combined container and applicator for sun lotion or the like ("the like" being various types of topical solutions). This improved version of the combined container and applicator serves several more functions and is cosmetically more appealing than its predecessor. The present invention is able to spray, roll or sponge on a wide variety of solutions.

The main body 1 is a container which is capable of holding a wide variety of solutions. The main body is now equipped with 4 slots which function as housing areas for sponges 4. It should be noted that the slots are also capable of housing additional roller balls (not shown). The main body is hollow on the inside. The main body is threaded on both ends to provide a means of adjoining with a spray cap 3, a sealer cap 6 and a large sealer cap 5. The main body of the present invention enables the combined container and applicator to perform more functions while also enhancing appearance of same. The main body may be constructed of plastic or metal-like materials. The main body is formed by a blow-molding process.

The roller ball 2 snaps into the sealer cap 6. The roller ball is round and serves the function of transferring solutions from inside the main body onto the surface of the entity on which the solution is being applied. The roller ball is able to provide a massaging effect when the person applying a solution moves the applicator in a circular or back-and-forth motion at varying degrees of pressure. The roller ball works in conjunction with the sealer cap 6 in keeping a solution from spilling out of the container. The roller ball may be removed from the sealer cap. The roller ball is made of plastic-like materials and is either injection-molded or extruded.

The spray cap 3 is currently used in many spray bottles which dispense common liquid (i.e. water, hair spray, suntan oil, etc.). The spray cap screws onto the main body 1. The spray cap assists in keeping a solution from spilling out of the main body. The spray cap is constructed of plastic-like and metal-like materials.

The sponges 4 insert into the main body 1 at different positions. Adding the sponges 4 to the combined container and applicator allow for a wider area of application. When using soaps and shampoos in the applicator the sponges 4 enable the user to achieve cleansing as well as application. The sponges are made to be retractable from top positions of the main body 1 to side positions of same in order for the roller ball to achieve utmost penetration when applying muscle rubs or ice. The sponges may be made of various sponge-like or plastic-like (ex. neoprene) materials. The sponges may contain plastic bases (not shown) to allow for convenient removal and insertion from and into slots (sponge receptors) on main body 1.

The large sealer cap 5 screws onto the main body. The large sealer cap 5 serves the function of preventing leakage. The large sealer cap 5 may be constructed of plastic or metal-like materials. The large sealer cap screws on to main body over the sealer cap 6. The large sealer cap is injection-molded.

The sealer cap 6 screws onto the main body 1. The sealer cap 6 contains an inner snap ring (not shown) which allows for insertion and removal of roller ball 2 or sponge 4. The sealer cap is equipped with prongs 12 which insert into grooves 14 located on a control disc 10. The sealer cap utilizes the technology of a child-proof cap so that the cap is able to turn after achieving a sealing effect. The sealer cap 6 is constructed of plastic and plastic-like materials. The sealer cap works in conjunction with the flow control system 16 in controlling the flow of any solution held within the combined container and applicator.

The flow control system 16 contains a flow tub 8 and a control disc 10 positioned therein. The flow control system controls the flow of any solution contained within the combined container and applicator. The flow control system is placed inside the main body 1. The flow control system is removable for the purposes of effective ice application and dishwasher cleansing. The flow control system 16 comprises a flow tub 8 and a control disc 10. The control disc 10 snaps onto the flow tub 8 by means of interconnecting the female receptor-nub and the mail insertion nub 9. The control disc is then rotated or turned by turning the sealer cap 6 which contains prongs 12 which fit into grooves 14 located on the control disc 10. By turning the control disc, flow holes 13 & 15 located on the flow-tub 8 and control disc 10, respectively, are designed to either permit or inhibit the flow of any solution contained within the combined container and applicator. Obviously, when the flow holes 13 & 15 are directly aligned total flow is allowed. As the flow holes lose their direct alignment, less solution is able to be dispersed. The flow control system is constructed of plastic components.

The sponge cover 7 protects the sponges from leakage and wear and tear. The sponge cover fits over the sponges. The sponge cover slides into the slots of the main body 1 when sponges are not in use. The sponge cover is made of plastic.

Although the invention has been discussed and described with primary emphasis of one embodiment, it should be obvious that adaptations and modifications can be made without departing from the spirit and scope of the invention.

What is claimed is:

1. An apparatus for effectively applying a wide variety of solutions to the body of a user comprising:

a hand-held container having first and second ends and a hollow interior chamber for containing solution therein;

a sealer cap removably attached to said first end of said container a roller ball removably attached to said sealer cap and adapted to dispense solution from said interior chamber to the body of a user;

a plurality of sponges removably mounted to said container adjacent to said roller ball such that said sponges and said roller ball are adapted to contact the user's body at the same time to effectively apply solution thereto;

a plurality of mounting means positioned on said container and spaced from said first end whereby each of said plurality of sponges can be removed from said first end of said container and positioned in a respective mounting means to thereby store said sponges in a retracted position on said container in order to enable a user to use only the roller ball to contact the body.

2. The apparatus as defined in claim 1 and further including a spray cap removably mounted to said second end of said container for enabling the solution to be sprayed from said container to the user.

3. The apparatus as defined in claim 1 wherein said sealer cap is adapted to release said roller ball and securely support an additional sponge thereon such that only a sponge surface contacts the user's body.

4. The apparatus as defined in claim 1 and further including a flow control means for controlling the amount of solution dispensed from said container.

5. The apparatus as defined in claim 4 wherein said flow control means includes a tub having apertures therein and a disk having apertures therein wherein said disk is attached to said sealer cap such that when said sealer cap is rotated, said apertures in said disk are aligned with apertures in said tub to thereby dispense a selected amount of solution.

* * * * *